US009003930B2

(12) United States Patent
Mitchell

(10) Patent No.: US 9,003,930 B2
(45) Date of Patent: Apr. 14, 2015

(54) CLAMPING PLIERS

(71) Applicant: Private Brand Tools (Australia) Pty Ltd, Queensland (AU)

(72) Inventor: David Mitchell, Queensland (AU)

(73) Assignee: Private Brand Tools (Australia) Pty Ltd, Queensland (AU)

( * ) Notice: Subject to any disclaimer, the term of this patent is extended or adjusted under 35 U.S.C. 154(b) by 273 days.

(21) Appl. No.: 13/684,409

(22) Filed: Nov. 23, 2012

(65) Prior Publication Data

US 2014/0144298 A1 May 29, 2014

(51) Int. Cl.
*B25B 7/02* (2006.01)
*B25B 7/14* (2006.01)

(52) U.S. Cl.
CPC .... *B25B 7/02* (2013.01); *B25B 7/14* (2013.01)

(58) Field of Classification Search
CPC ..... B25B 5/04; B25B 5/06; B25B 5/064; B25B 5/12; B25B 5/16; B25B 7/02; B25B 7/04; B25B 7/08; B25B 7/12; B25B 7/14; B25B 7/18; B25B 7/22
USPC ..... 81/318–325, 328–333, 336–340, 417; 269/6, 67, 90, 237
See application file for complete search history.

(56) References Cited

U.S. PATENT DOCUMENTS

| | | | | | |
|---|---|---|---|---|---|
| 507,973 | A * | 10/1893 | Cox | 81/336 |
| 923,848 | A * | 6/1909 | Johnson | 81/321 |
| 1,433,668 | A * | 10/1922 | Stein | 81/321 |
| 1,561,833 | A * | 11/1925 | Cruickshank | 81/337 |
| 1,625,615 | A * | 4/1927 | Kuttes | 81/365 |
| D400,414 | S | 11/1998 | Wilson et al. | |
| 6,336,386 | B1 * | 1/2002 | Lee | 81/328 |
| 6,708,587 | B1 * | 3/2004 | Noniewicz et al. | 81/322 |
| 6,860,179 | B2 * | 3/2005 | Hopper et al. | 81/318 |

OTHER PUBLICATIONS

ABW Catalogue, 3 pages, (1995).

* cited by examiner

*Primary Examiner* — Hadi Shakeri
(74) *Attorney, Agent, or Firm* — Nixon & Vanderhye, PC

(57) ABSTRACT

Fluid line clamping pliers include shanks, jaws, handles, a pivot connecting the shanks such that first and second jaws are opposed to one another and movable using first and second handles within a common plane between a clamping position and a non-clamping position. The pliers include a biasing mechanism, a locking mechanism, and a retainer return mechanism. A retainer is adapted to be pivoted to a locking position using an index finger of an operator of the clamping pliers while the operator's other fingers grasp the handles of the clamping pliers, and the retainer return mechanism is adapted to move the retainer from a locking position to a non-locking position when the operator squeezes the handles towards one another while the jaws are in a clamping position.

6 Claims, 5 Drawing Sheets

CLAMPING PLIERS

TECHNICAL FIELD

The present invention concerns clamping pliers for pinching closed a fluid line. In particular, the invention concerns clamping pliers having a locking mechanism that can be used to pinch closed a fluid line using a single hand.

BACKGROUND OF THE INVENTION

In the automotive industry, fluid lines in the form of flexible pipes or hoses are used to convey fluids such as air, coolant, oil and fuel from one vehicle component to another. During servicing of a vehicle it may be necessary to disconnect or cut a fluid line, in which case fluid could leak from an opening in the fluid line unless manually sealed by a technician.

Depending on the nature of the fluid line and the fluid leaking therefrom, technicians may simply allow the fluid to drain from within the fluid line into a collection container (eg. pan), or temporarily seal the opening in the fluid line by way of a closure such as a plug, or temporarily close off a flexible fluid line by way of a hose clamp (pinch-off pliers) or by kinking the line.

One disadvantage of known pinch-off pliers is that an operator must use both hands when operating the pliers. In particular, the locking mechanism of known pliers are not user friendly and require two hands to position. Also, the release of the locking mechanism requires two hands.

SUMMARY OF THE INVENTION

The present inventor has now developed clamping pliers having a locking mechanism that can be used to pinch closed a fluid line using a single hand.

According to the present invention, there is provided clamping pliers for pinching closed a fluid line comprising:

a first shank, a first jaw extending from the first shank and a first handle extending from the first shank;

a second shank, a second jaw extending from the second shank and a second handle extending from the second shank;

a pivot connecting the first and second shanks such that the first and second jaws are opposed to one another and movable using the first and second handles within a common plane between a clamping position in which the jaws can pinch closed a fluid line and a non-clamping position;

a biasing mechanism for moving the first and second jaws to the non-clamping position; and a locking mechanism for locking the first and second jaws in the clamping position, said locking mechanism comprising:

a retainer pivotally connected to the first shank and pivotable between a locking position and a non-locking position, wherein in the locking position the retainer engages the second shank to lock the first and second jaws in the clamping position; and a retainer return mechanism for returning the retainer from the locking position to the non-locking position, wherein said retainer is adapted to be pivoted to the locking position using an index finger of an operator of the clamping pliers whilst the operator's other fingers grasp the handles of the clamping pliers, and said retainer return mechanism is adapted to move the retainer from the locking position to the non-locking position when the operator squeezes the handles towards one another whilst the jaws are in the clamping position.

As used herein the term 'fluid line' refers to any flexible conduit, tubing, pipe or hose, or conduit, tube, pipe or hose assembly within which fluid (eg. liquid or gas or solid particulates may be conveyed).

Each jaw may be of any suitable size, shape and construction and formed of any suitable material or materials. Typically, the jaws will be made of metal or plastics material, but preferably plastics material. Each jaw may have a clamping edge that either directly or indirectly engages a fluid line when in a clamping position.

Each handle may be of any suitable size, shape and construction and can be made of any suitable material or materials. Typically, the handles will be made of metal or plastics material, but preferably plastics material. Preferably, the handles are able to slightly flex toward one another within the common plane whilst clamping the jaws to the fluid line, so that the locking mechanism can lock the jaws in a tighter clamping position and provide a tighter clamping action.

The clamping pliers may comprise a grip extending along one or more of the handles. The handles may be arcuate. The second handle may have a toe adapted to extend partway around an operator's little finger. The handles may have strengthening walls or ribs, as commonly used for moulded plastics materials.

Each shank may be of any suitable size, shape and construction and may be made of any suitable material or materials. Typically, the shanks will be made of metal or plastics material, but preferably plastics material.

Preferably the first shank, first jaw and first handle are of unitary construction. Preferably the second shank, second jaw and second handle are of unitary construction.

Any suitable type of pivot may be used. The pivot may be a pivot pin having enlarged shank-engaging ends. The shanks may cross over one another in any suitable way and a pivot pin may extend through the shanks and pin them together (much like a scissor arrangement).

The first shank may comprise an opening through which the second shank extends. The first shank may comprise a pair of spaced walls and provide an opening between those walls. The pivot pin may extend through those walls and further through the second shank, so as to pin the second shank between the walls of the first shank.

Preferably the shanks, jaws and handles extend within the common plane and the pivot pin extends substantially at a right angle to that common plane.

The biasing mechanism may be of any suitable size, shape and construction and may be formed of any suitable material or materials. The biasing mechanism may be a spring extending between the shanks or jaws or handles, such as a helical torsion spring or a leaf spring. The spring may be made of sprung steel, plastics material or rubber. Preferably, a helical spring extends around the pivot pin and a first end of the spring bears against the first shank or first handle and a second end of the spring bears against the second shank or second handle so as to push the first and second shanks or handles apart, and squeezing the handles together works against the force of the spring.

The locking mechanism for locking the first and second jaws in the clamping position may be of any suitable size, shape and construction and may be formed of any suitable material or materials. Typically, the locking mechanism will be made of metal and/or plastics material.

The locking mechanism may comprise a mounting pin for mounting the retainer to the first shank. The mounting pin may extend substantially parallel with the pivot pin within and through the spaced walls of the first shank. The mounting pin may have enlarged shank-engaging ends.

The retainer may be of any suitable size, shape and construction. The retainer may be, for example, substantially U-shaped, in the form of a loop or ring, substantially J-shaped, substantially L-shaped, or in the form of a hook. The retainer may comprise at least one shank-mounting arm through which extends the mounting pin. The retainer may comprise a shank-retaining region that releasably engages the second shank. Preferably, the at least one shank-mounting arm of the retainer extends from the mounting pin alongside the second shank and the shank-retaining region of the retainer extends from the shank-mounting arm around (ie. hooks around) an edge of the second shank.

The locking mechanism may comprise the second shank having a retainer-engaging region or edge adapted to engage the retainer, particularly the shank-retaining region. Preferably the retainer-engaging region or edge and shank-retaining region extend substantially at a right angle relative to the common plane.

Preferably, the retainer is in the form of a (locking) ring having a pair of shank-mounting arms extending from the mounting pin along each side of the second shank and further around the retainer-engaging region or edge of the second shank. The shank-retaining region may extend from each shank-mounting arm adjacent the retainer-engaging region or edge. The shank-mounting arms may further extend from the mounting pin away from the shank-retaining region so as to meet adjacent the mounting pin. The shank-mounting arms may be arcuate when viewed in side elevation.

The shank-retaining region may engage the retainer-engaging region or edge of the second shank in any suitable way. In one embodiment, the shank-retaining region engages the retainer-engaging region or edge similar to a ratchet and pawl configuration whereby the retainer is shaped like a pawl that is pivotable into and out of engagement with the retainer-engaging region or edge which is shaped like a toothed ratchet.

Preferably, the retainer-engaging region or edge is saw-toothed (or serrated, or undulating), the shank-retaining region of the retainer is sawtoothed (or serrated, or undulating), and the shank-retaining region may be pivoted into and out of engagement with the sawtoothed retainer-engaging region or edge of the second shank. When engaged, the teeth/serrations/undulations of the shank-retaining region positively engage and are retained by the teeth/serrations/undulations of the retainer-engaging region or edge of the second shank.

The locking mechanism may further comprise at least one travel stop for preventing the retainer from pivoting beyond a certain point relative to the second shank. The travel stop may be of any suitable size, shape and construction and may be formed of any suitable material or materials. Typically, the travel stop will be made of metal and/or plastics material, but preferably plastics material. Preferably, the travel stop is of unitary construction with the first and/or second shank. The first shank or first jaw may prevent the retainer from pivoting beyond the non-locking position. The second shank may prevent the retainer from pivoting beyond the locking position.

The retainer return mechanism for returning the retainer from the locking position to the non-locking position may be of any suitable size, shape and construction and may be formed of any suitable material or materials. The retainer return mechanism may be a spring such as a helical torsion spring or a leaf spring. The spring can be made of sprung steel, plastics material or rubber. Preferably, a helical spring extends around the mounting pin and a first end of the spring bears against the first shank or first handle and a second end of the spring bears against the retainer so as to urge the retainer to the non-clamping position.

The clamping pliers may further comprise a jaw plate pivotally connected to each jaw, so as to ensure parallel and level clamping of a fluid line. Each jaw plate may be of any suitable size, shape and construction and may be formed from any suitable material or materials. Typically, each jaw plate will be made of metal or plastics material, but preferably plastics material. The shape of each jaw plate will depend on the nature of the fluid line that is to be pinched closed.

Each jaw plate may be pivotally connected to each jaw in any suitable way. Preferably, each jaw plate extends along a clamping edge of each jaw so as to provide a broad and flat fluid line-clamping surface. Each jaw plate can further extend partway around each jaw for pivotal connection to said jaw. The pivotal connection may comprise mateable female and male regions of the jaw and jaw plate.

Preferably, the clamping pliers are formed by plastic moulding.

The clamping pliers may be of two sizes. The smaller of the two may be used for the crimping off of vacuum lines, fuel lines and smaller diameter heater hoses. The larger of the two may be used for larger diameter heater hoses and radiator hoses.

An embodiment of the invention will now be described, by way of example only, with reference to the following figures.

DETAILED DESCRIPTION

Figure 1:
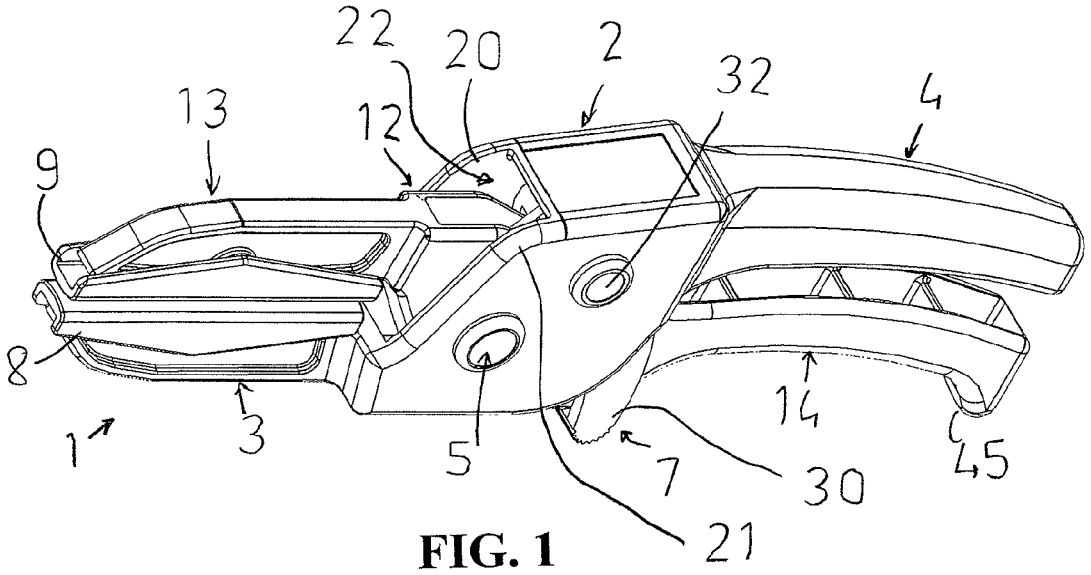
FIG. 1 is a top side perspective view of clamping pliers for pinching closed a fluid line, with jaws of the clamping pliers shown in a clamping position, according to an embodiment of the present invention.

In the figures, like reference numerals refer to like features.

Figure 10:
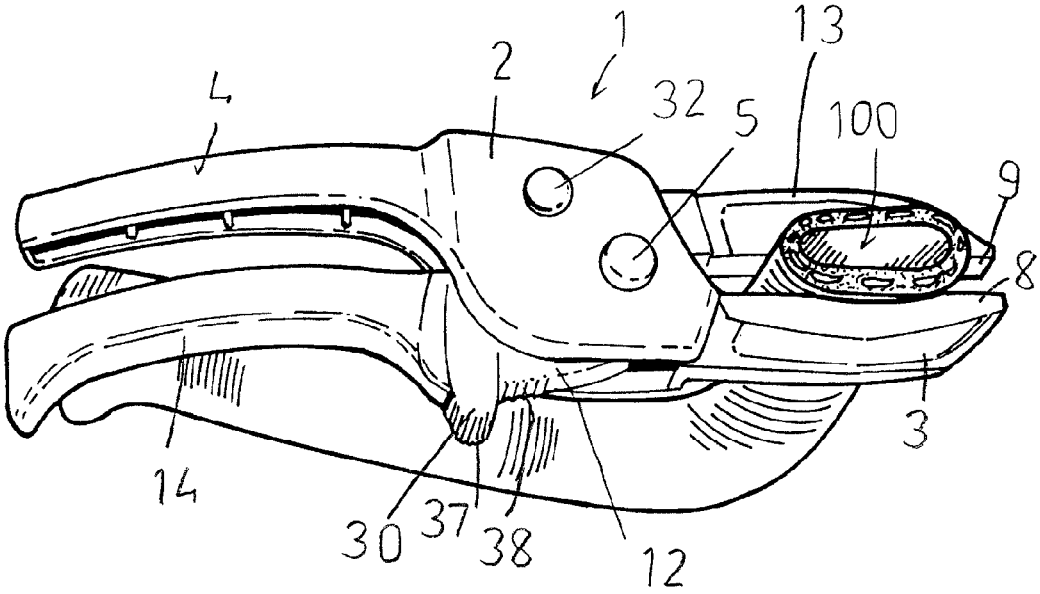
FIG. 10 is a bottom side perspective view of the clamping pliers shown in FIG. 1 when pinching closed a fluid line (radiator hose)
Figure 11:
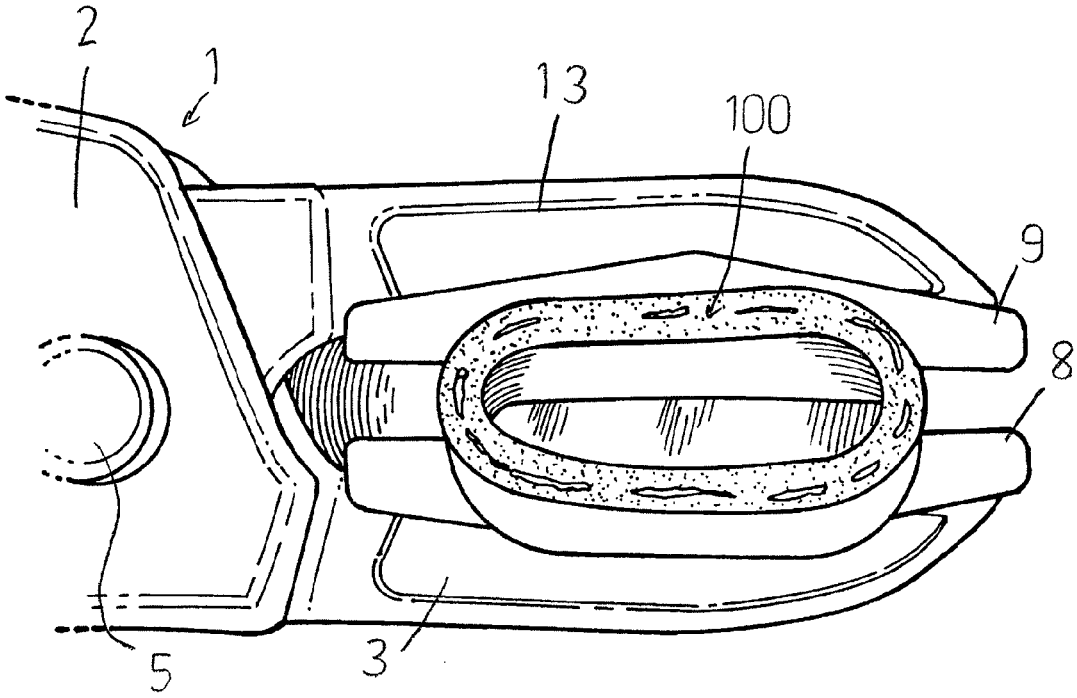
FIG. 11 is a close-up view of that shown in FIG. 10, but in side elevation.

The figures show clamping pliers 1 for pinching closed a fluid line 100 (eg. a rubber radiator hose as seen in FIGS. 10 and 11). The clamping pliers 1 comprise a first shank 2, a first jaw 3, a first handle 4, a second shank 12, a second jaw 13, a second handle 14, a pivot 5, a biasing mechanism 6 (see FIG. 3), a locking mechanism 7 (see FIGS. 2 and 8) and jaw plates 8, 9.

The first shank 2, first jaw 3 and first handle 4 are of unitary construction and are made of moulded plastics material. Likewise, the second shank 12, second jaw 13 and second handle 14 are of unitary construction and are made of moulded plastics material. The shanks 2, 12, jaws 3, 13 and handles 4, 14 extend within a common plane.

Figure 9:
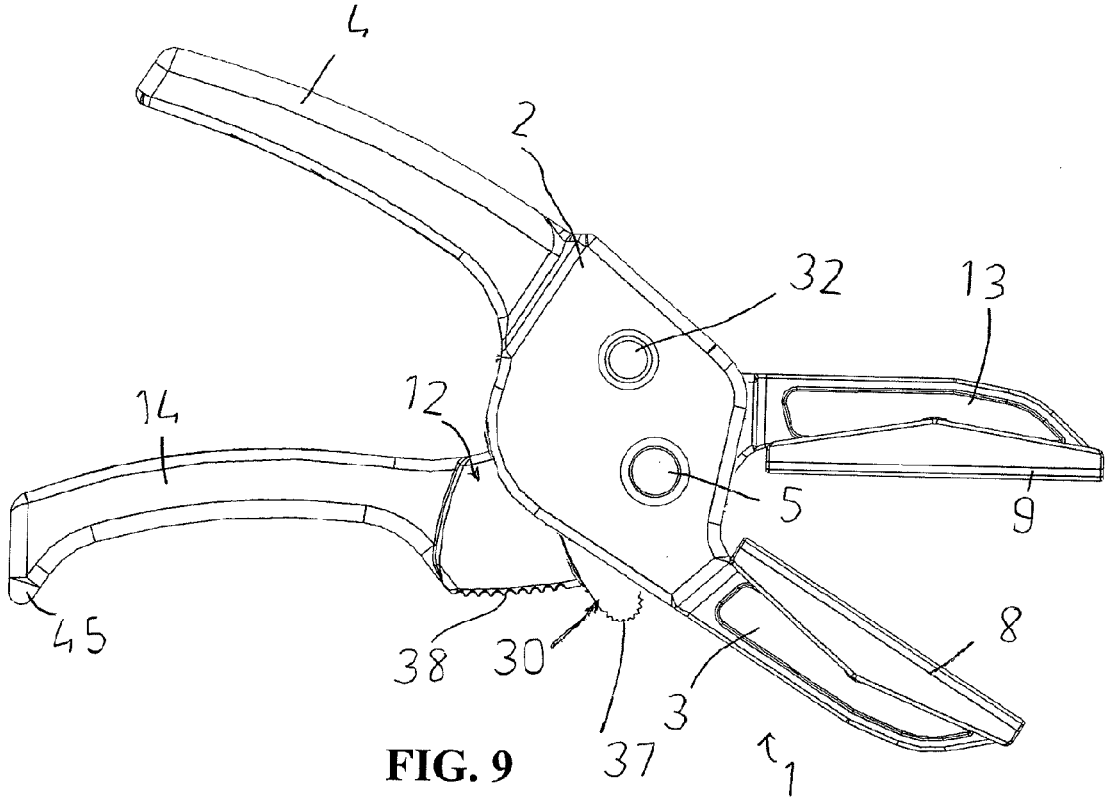
FIG. 9 is a second side elevation view of the clamping pliers shown in FIG. 1 but with jaws of the clamping pliers shown in a non-clamping position.

The pivot 5 is in the form of a pivot pin 5 and connects the first and second shanks 2, 12 (much like a scissor arrangement) such that the first and second jaws 3, 13 are opposed to one another and movable by way of the first and second handles 4, 14 between a clamping position (as seen in FIGS. 1 and 10) in which they can pinch closed a fluid line 100 and a non-clamping position (as seen in FIG. 9).

Figure 7:
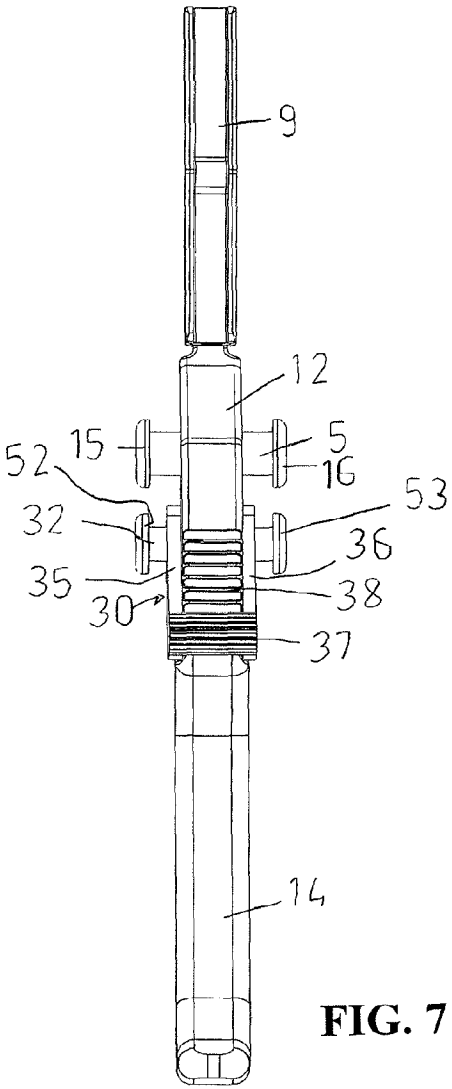
FIG. 7 is a bottom plan view of part of the clamping pliers shown in FIG. 1, but shown without a first shank, first handle and first jaw.
Figure 4:
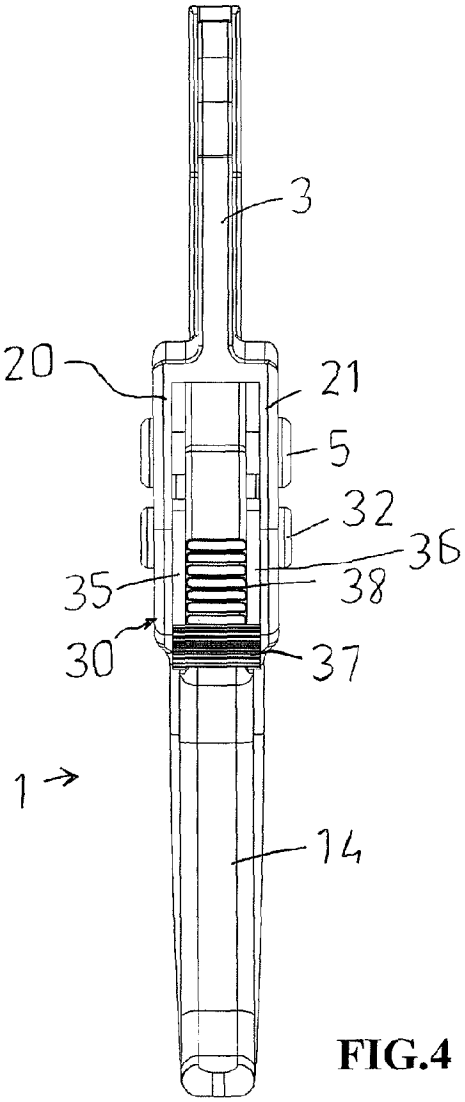
FIG. 4 is a bottom plan view of the clamping pliers shown in FIG. 1.

The first shank 2 comprises a pair of spaced walls 20, 21 and provides an opening 22 between those walls 20, 21 through which the second shank 12 extends (see FIG. 1). The pivot pin 5 extends through those walls 20, 21 and further through the second shank 12, so as to pin the second shank 12 between the walls 20, 21 of the first shank 2. The pivot pin 5 is best seen in FIG. 7 and has enlarged shank-engaging ends 15, 16. The pivot pin 5 extends at a right angle to the common plane.

Figure 3:
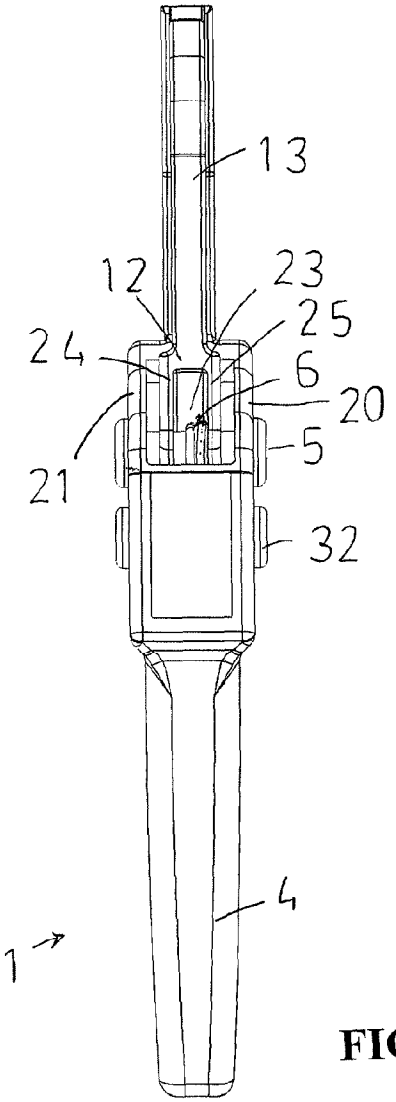
FIG. 3 is a top plan view of the clamping pliers shown in FIG. 1.
Figure 5:
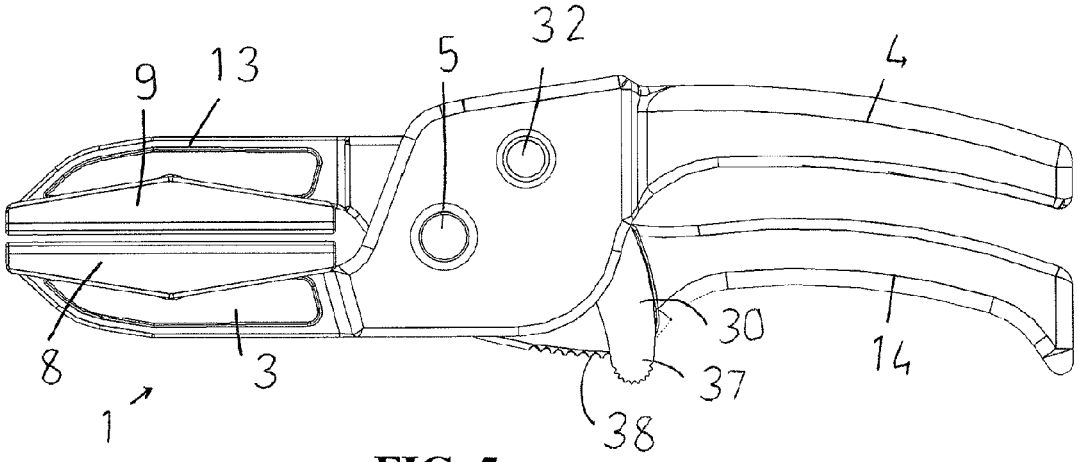
FIG. 5 is a first side elevation view of the clamping pliers shown in FIG. 1.
Figure 6:
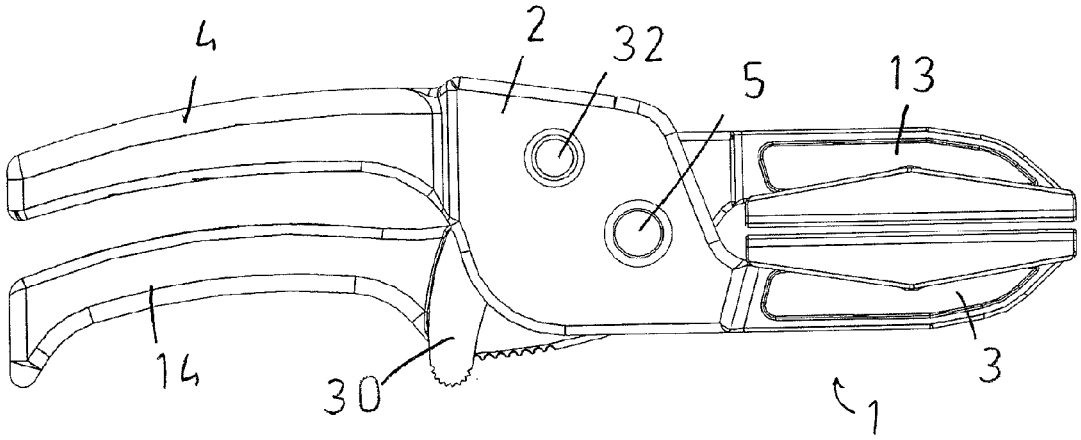
FIG. 6 is a second side elevation view of the clamping pliers shown in FIG. 1.

The biasing mechanism 6 comprises a helical spring 6 and moves the first and second jaws 3, 13 to the non-clamping position. As seen in FIG. 3, the helical spring 6 extends around the pivot pin 5 within a cavity 23 located between two spaced-apart walls 24, 25 of the second shank 12. A first end of the spring 6 extends from the pivot pin 5 and bears against the first shank 2 and first handle 4. A second end of the spring 6 extends from the pivot pin 5 and bears against the second shank 12. In this way the spring 6 urges the first and second handles 4, 14 apart, as seen in FIG. 9.

Figure 8:
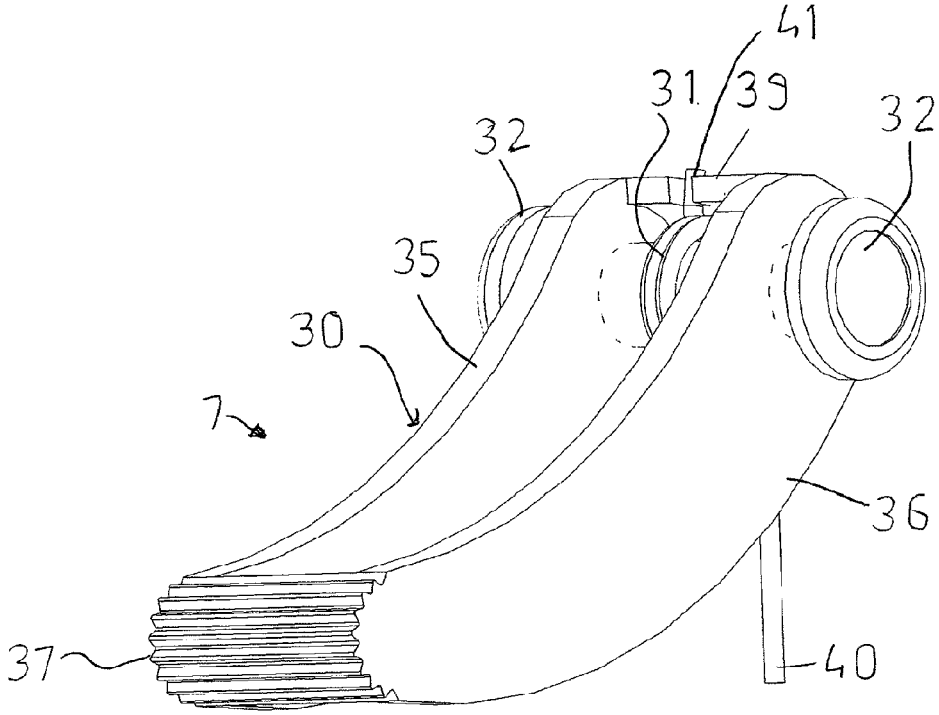
FIG. 8 is a perspective view of part of a locking mechanism of the clamping pliers shown in FIG. 1.

The locking mechanism 7 locks the first and second jaws 3, 13 in the clamping position and comprises a retainer 30, a retainer return mechanism 31 and a mounting pin 32, as best seen in FIG. 8.

Figure 2:
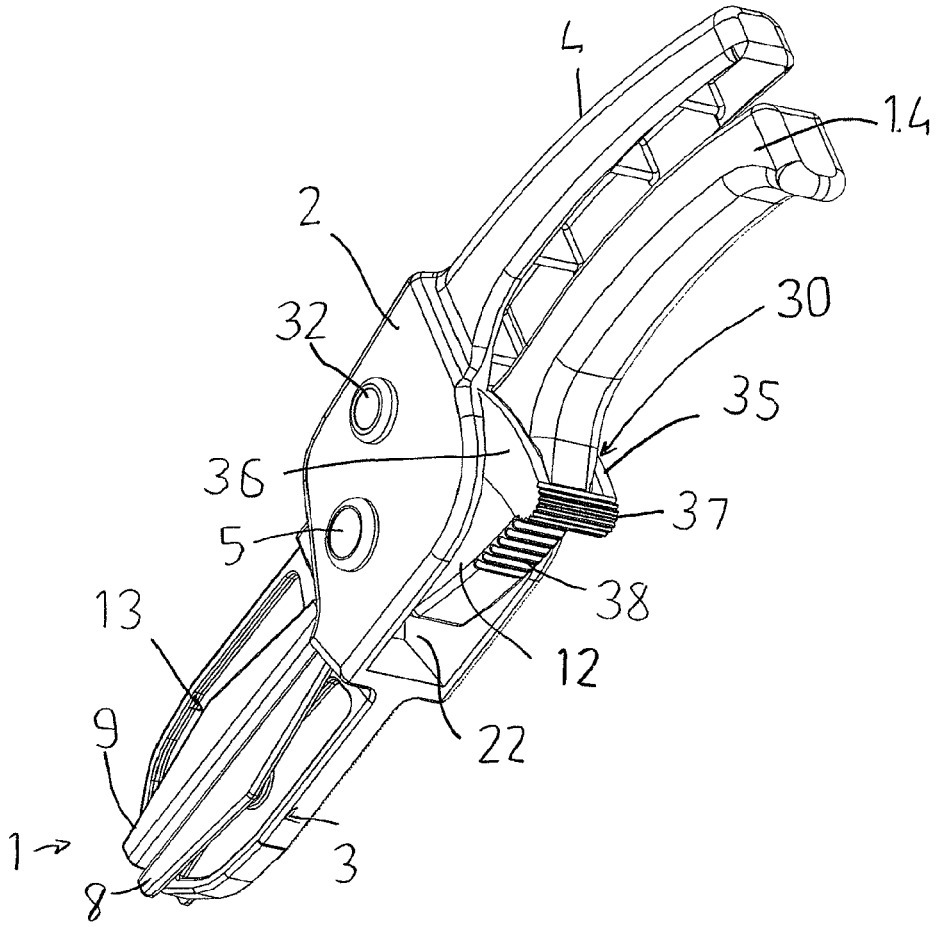
FIG. 2 is a bottom side perspective view of the clamping pliers shown in FIG. 1.

The retainer 30 is pivotally connected to the first shank 2 and pivotable between a locking position (as seen in FIG. 2) and a non-locking position (as seen in FIG. 9), wherein in the locking position the retainer 30 engages the second shank 12 to retain the first and second jaws 3, 13 in the clamping position.

The retainer 30 is adapted to be pivoted to the locking position using an index finger of an operator of the clamping pliers 1 whilst the operator's other fingers grasp the handles 4, 14 of the clamping pliers 1. The retainer return mechanism 31 is adapted to move the retainer 30 from the locking position to the non-locking position when the operator squeezes the handles 4, 14 towards one another whilst the jaws 3, 13 are in the clamping position.

The mounting pin 32 mounts the retainer 30 to the first shank 2. The mounting pin 32 extends substantially parallel with the pivot pin 5 within and through the spaced walls 20, 21 of the first shank 2. The mounting pin 32 has enlarged shank-engaging ends 52, 53 as seen in FIG. 7.

The retainer 30 is in the form of a locking ring 30 of unitary construction. The ring 30 comprises a pair of spaced arcuate shank-mounting arms 35, 36 through which extends the mounting pin 32. The retainer/ring 30 also comprises a shank-retaining region 37 that releasably engages the second shank 12. Each shank-mounting arm 35, 36 extends from the mounting pin 32 alongside the second shank 12 and the shank-retaining region 37 extends from each shank-mounting arm 35, 36 around an edge of the second shank 12. The ring 30 further comprises a loop portion 39 that extends parallel with the mounting pin 32 and shank-retaining region 37, and connects to each shank-mounting arm 35, 36.

As seen in FIG. 2, the locking mechanism 7 further comprises the second shank 12 having a retainer-engaging edge 38 adapted to engage the shank-retaining region 37. The retainer-engaging edge 38 and shank-retaining region 37 extend substantially at a right angle relative to the common plane.

The retainer-engaging edge 38 is sawtoothed, the shank-retaining region 37 is sawtoothed, and the shank-retaining region 37 can be pivoted into and out of engagement with the sawtoothed retainer-engaging edge 38. When engaged, the teeth of the shank-retaining region 37 positively engage and are retained by the teeth of the retainer-engaging edge 38.

As seen in FIG. 8, the retainer return mechanism 31 for returning the retainer 30 from the locking position to the non-locking position is a helical torsion spring 31. The spring 31 extends around the mounting pin 32 between the shank-mounting arms 35, 36 and adjacent loop portion 39. A first end 40 of the spring 31 extends from the mounting pin 32 and bears against the first shank 2 and first handle 4. A second end 41 of the spring 31 extends from the mounting pin 32 and bears against loop portion 39 (within a slit). In this way the spring 31 urges the retainer/loop 30 to the non-clamping position, as seen in FIG. 9

The first jaw 3 prevents the retainer/loop 30 from pivoting past the non-locking position. The second shank 12 prevents the retainer/loop 30 from pivoting past the locking position. The first jaw 3 and second shank 12 act as travel stops.

Each handle 4, 14 is slightly accurate and can slightly flex toward one another whilst clamping the jaws 3, 13 to the fluid line 100, so that the locking mechanism 7 can lock the jaws 3, 13 in a tighter clamping position and provide a tighter clamping action. The handles 4, 14 can also be squeezed towards each other so as to release the retainer/ring 30 from engagement with the second shank 12. The second handle 14 has a toe 45 adapted to extend partway around an operator's little finger. Each handle 4, 14 has internal strengthening walls or ribs, as commonly used for plastics materials, as seen in FIGS. 1 and 2.

Each jaw plate 8, 9 is pivotally connected to a respective jaw 3, 13 by way of mateable female and male regions. Each jaw plate 8, 9 extends along a clamping edge of each jaw 3, 13 so as to provide a broad and flat fluid line-clamping surface. Each jaw plate 8, 9 further extends partway around each jaw 3, 13 for pivotal connection to said jaw 3, 13. The jaw plates 8, 9 ensure parallel and level clamping of the fluid line 100.

In use, the jaw plates 8, 9 are positioned adjacent opposing surfaces of a fluid line 100 and, using a single hand, the handles 4, 14 are squeezed together by an operator so as to pinch the fluid line 100 closed. Whilst the fluid line 100 is pinched closed, the operator continues to squeeze the handles together and uses his/her index finger to pivot the retainer/ring 30 such that the teeth of the shank-retaining region 37 positively engage and are retained by the teeth of the retainer-engaging edge 38.

The operator then releases the handles 4, 14 and the jaws 3, 13 remain tightly clamped to the fluid line 100. In order to release the fluid line 100, the operator squeezes together the handles 4, 14 and the shank-retaining region 37 automatically disengages from the retainer-engaging edge 38 due to the action of the retainer return mechanism spring 31.

The advantages of the clamping pliers as broadly described or exemplified include that:

it has a locking mechanism that can be applied easily using one hand, whereas the locking mechanism of known pliers are not user friendly and require two hands to position;

the release of the locking mechanism occurs automatically by simply applying a squeeze force to the handles, whereas known pliers require two hands to release the locking mechanism;

the pivoting jaw plates offer a parallel crush force as opposed to scissor-type crush force which applies heavier crush to one side of the hose before fully pinching off the opposing side;

the pass-through shank design offers very high strength with minimal wall section. (This also offers consistent wall sections, which is important for the moulding of the components.); and the flexing of handles when clamping create a positive pinch-off of rubber hoses. The handles are moved slightly beyond the optimum crush point to apply the retainer ring, so as when the force is released from the handles, it does not release the full crush on the hose.

The foregoing embodiments are illustrative only of the principles of the invention, and various modifications and changes will readily occur those skilled in the art will stop the invention is capable of being practice and carry out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context of usage an exclusive interpretation of the term is required.

The invention claimed is:

1. Clamping pliers for pinching closed a fluid line comprising:

a first shank, a first jaw extending from the first shank and a first handle extending from the first shank;

a second shank, a second jaw extending from the second shank and a second handle extending from the second shank;

a pivot comprising a pivot pin connecting the first and second shanks such that the first and second jaws are opposed to one another and movable using the first and second handles within a common plane between a clamping position in which the jaws can pinch closed a fluid line and a non-clamping position;

a biasing mechanism for moving the first and second jaws to the non-clamping position, wherein the biasing mechanism comprises a spring extending around the pivot pin and a first end of the spring bears against the first shank or first handle and a second end of the spring bears against the second shank or second handle so as to push the first and second shanks or handles apart; and a locking mechanism for locking the first and second jaws in the clamping position, said locking mechanism comprising:

a retainer pivotally connected to the first shank and pivotable between a locking position and a non-locking position, wherein in the locking position the retainer engages the second shank to lock the first and second jaws in the clamping position;

a mounting pin that mounts the retainer to the first shank; and a retainer return mechanism for returning the retainer from the locking position to the non-locking position, wherein the retainer return mechanism comprises a helical spring extending around the mounting pin and a first end of the spring bears against the first shank or first handle and a second end of the spring bears against the retainer so as to urge the retainer to the non-clamping position, wherein:

said retainer is adapted to be pivoted to the locking position using an index finger of an operator of the clamping pliers whilst the operator's other fingers grasp the handles of the clamping pliers, and said retainer return mechanism is adapted to move the retainer from the locking position to the non-locking position when the operator squeezes the handles towards one another whilst the jaws are in the clamping position;

the first shank comprises a pair of spaced walls that provide an opening through which the second shank extends, and said pivot pin extends through the spaced walls and second shank;

the retainer comprises a pair of shank-mounting arms through which extends the mounting pin, and a shank-retaining region that releasably engages the second shank;

the locking mechanism comprises the second shank having a retainer-engaging region adapted to engage the shank-retaining region; and the retainer is in the form of a locking ring whereby the pair of shank-mounting arms extend along each side of the second shank and the shank-retaining region further extends around the retainer-engaging region of the second shank.

2. The clamping pliers of claim 1, wherein the handles are able to slightly flex toward one another within the common plane whilst clamping the jaws to the fluid line, so that the locking mechanism can lock the jaws in a tighter clamping position and provide a tighter clamping action.

3. The clamping pliers of claim 1, wherein the shank-mounting arms are arcuate when viewed in side elevation.

4. The clamping pliers of claim 1, wherein the retainer-engaging region is sawtoothed, the shank-retaining region of the retainer is sawtoothed, and the shank-retaining region is pivotable into and out of engagement with the sawtoothed retainer-engaging region.

5. The clamping pliers of claim 1 further comprising a jaw plate pivotally connected to each jaw, so as to ensure parallel and level clamping of a fluid line.

6. The clamping pliers of claim 1, wherein the first shank, first jaw and first handle are of unitary construction, and wherein the second shank, second jaw and second handle are of unitary construction.

* * * * *